US005435488A

United States Patent [19]

Abiko

[11] Patent Number: 5,435,488

[45] Date of Patent: Jul. 25, 1995

[54] METHOD AND APPARATUS FOR DISCHARGING LIQUID THROUGH A NOZZLE HAVING A HOOD

[75] Inventor: Yukifusa Abiko, Tokyo, Japan

[73] Assignee: Nordson Corporation, Westlake, Ohio

[21] Appl. No.: 198,148

[22] Filed: Feb. 17, 1994

[51] Int. Cl.[6] ..... B05B 15/02

[52] U.S. Cl. ..... 239/110; 239/112; 239/288.3; 134/104.1; 222/148

[58] Field of Search ..... 239/8, 104, 106, 110, 239/112, 288, 288.3; 222/145, 148; 134/104.1

[56] References Cited

U.S. PATENT DOCUMENTS

| | | | |
|---|---|---|---|
| 2,644,717 | 7/1953 | Kopperschmidt . | |
| 2,868,166 | 1/1959 | Brechenmacher . | |
| 2,953,248 | 9/1960 | Troland | 239/110 |
| 3,211,377 | 10/1965 | Brenner | 239/106 X |
| 3,228,412 | 1/1966 | Peterson et al. | 222/148 X |
| 3,842,680 | 10/1974 | Vollick et al. | 222/148 X |
| 3,857,511 | 12/1974 | Govindan . | |
| 3,963,180 | 6/1976 | Wagner . | |
| 4,020,982 | 5/1977 | Micallef . | |
| 4,036,434 | 7/1977 | Anderson et al. | 239/8 |
| 4,132,357 | 1/1979 | Blackinton . | |
| 4,200,232 | 4/1980 | Fraley et al. | 239/112 |
| 4,344,991 | 8/1982 | Gray . | |
| 4,734,706 | 3/1988 | Le et al. | 239/104 X |
| 4,998,993 | 3/1991 | Kenderi et al. . | |
| 5,211,335 | 5/1993 | Strid | 239/110 |
| 5,226,565 | 7/1993 | Hladis et al. | 222/148 X |

FOREIGN PATENT DOCUMENTS

| | | | |
|---|---|---|---|
| 2357257 | 5/1975 | Germany | 239/288.3 |
| 3439193 | 4/1986 | Germany | 239/110 |
| 2073105 | 10/1981 | United Kingdom . | |
| 2094180 | 9/1982 | United Kingdom | 239/112 |
| WO8903104 | 4/1989 | WIPO . | |
| WO8904727 | 6/1989 | WIPO . | |

*Primary Examiner*—Andres Kashnikow
*Assistant Examiner*—Lesley D. Morris
*Attorney, Agent, or Firm*—Wood, Herron & Evans

[57] ABSTRACT

An improved method and apparatus for discharging a liquid material which includes volatile components comprises a gun body for discharging the liquid from a nozzle orifice at a nozzle end thereof, and a hood mounted to the nozzle end, the hood defining an open inner space around the nozzle hole. The open space provided by the hood maintains the nozzle end in a state of relatively stable conditions to reduce viscosity changes and/or hardening of the liquid on the nozzle end, particularly during intermittent discharge operations. A water permeable liner may be located in the hood to actively humidify the discharged liquid as it traverses the open space. A cleaning nozzle may be aimed at the nozzle end of the gun body to direct a cleaning agent thereagainst, the cleaning agent being removed from the open space via an exhaust outlet aligned with the cleaning nozzle. One or more additional hoods may be used to provide further stages of protection.

17 Claims, 2 Drawing Sheets

METHOD AND APPARATUS FOR DISCHARGING LIQUID THROUGH A NOZZLE HAVING A HOOD

FIELD OF THE INVENTION

This invention relates to a method and apparatus for discharging a liquid which includes volatile components and which is particularly susceptible to problems associated with drying and/or clogging at a nozzle end during or after discharge.

BACKGROUND OF THE INVENTION

In apparatus which spray or discharge solvent borne coatings or adhesives, since the solvent evaporates off in the area of the nozzle, coating material components and adhesive materials sometimes accumulate thereon. As a solution to this problem, a solvent is sometimes sprayed onto the nozzle from a separate nozzle to prevent drying and adherence of the liquid or adhesive on the end of the discharge nozzle. The solvent is sprayed during interruption or after completion of discharge operations. However, the use of a separately sprayed solvent in this manner often results in solvent drops falling from the nozzle onto the surface to be coated, therefore disturbing the coating on the surface. This problem becomes particularly acute when the spray or injection quantity of the solvent is excessive.

In applications involving the discharge of coating material and/or adhesive onto individual items carried on a conveyor, intermittent discharge is desirable. However, some volatile components carried in the portion of the coating material or adhesive which is located in the flow passage between the dispensing valve and the discharge orifice tend to evaporate during breaks in the discharge operations. This evaporation causes viscosity changes in the coating material or adhesive when it is later discharged, which results in the discharge of varying amounts of liquid onto the successive items.

In other cases, material accumulation on the nozzle end and hardening over time is so severe that the end of the nozzle must be cleaned with a brush.

In cases where hardening occurs during the use of water soluble emulsive coatings or adhesives, harmful organic solvents such as toluene must be used for rinsing and/or cleaning the end of the nozzle. This further complicates the process, due to the harmful nature of the cleaning agent and the requirement to shut down coating operations during cleaning.

To prevent dispersing of harmful solvents within a plant during coating operations, solvent emission collection ducts connected to a fan may be located around the periphery of the application area to remove and collect solvent emissions. Unfortunately, the use of such collection ducts usually creates an air flow which further promotes adherence and hardening of the liquid at the nozzle end.

It is therefore an object of this invention to overcome problems associated with drying and hardening of liquid at a nozzle end of a spraying apparatus, a problem which is particularly acute when the liquid includes volatile components.

It is another object of this invention to eliminate viscosity changes in the coating material or adhesive located between the dispensing valve and the discharge orifice in intermittent coating operations, particularly in cases where the liquid includes volatile components.

It is still another object of the invention to reduce the amount of nozzle cleaning required during the discharge of a liquid which includes volatile components, and further to minimize the stoppage of coating operations required by such nozzle cleaning.

SUMMARY OF THE INVENTION

The above-stated objectives are achieved by a hood located at the nozzle end of a dispensing gun body, the hood defining an open inner space around the nozzle end and including an opening aligned with a nozzle orifice through which liquid coating material or adhesive is discharged. This structure maintains the end of the nozzle in a state of normal and relatively stable humidity, reduces viscosity changes in the liquid located at the end of the nozzle during intermittent operation, and substantially eliminates adherence and/or harding of discharged liquid at the end of the nozzle. Basically, the hood provides a stable, protected environment around the end of the nozzle. The environment within the inner space is free from the adverse effects of the ambient conditions and any air flows produced by the solvent emission collection ducts. Thus, the liquid is less susceptible to accumulating and drying on the end of the nozzle.

According to a preferred embodiment of the invention, the hood mounts directly to the end of a gun body, and the hood includes an opening aligned along an axis with a passage through the gun body which terminates at the nozzle orifice. The opening in the hood is larger than the nozzle orifice to accommodate spreading out of the spray pattern upon discharge from the nozzle orifice.

Upon discharge from the nozzle orifice, a liquid which includes volatile components traverses the open inner space within the hood. This space acts as a first protection stage for the end of the nozzle. If desired, one or more additional hoods may be mounted in succession to provide additional stages of protection.

According to a second preferred embodiment of the invention, a permeable element is located within the hood to humidify the open inner space during discharge operations.

According to a third preferred embodiment of the invention, during breaks in liquid discharge, a separate cleaning nozzle which is mounted within the open inner space and aimed toward the nozzle discharges a cleaning agent against the nozzle. This prevents adherence or harding of liquid at the end of the nozzle by washing off any liquid which has accumulated on the nozzle. An outlet aligned with the cleaning nozzle is utilized to remove the cleaning agent from the open space.

If desired, as with the first and second embodiments, this embodiment may be used where the liquid coating material or adhesive is being discharged in a vertical or a horizontal direction. If the liquid material is being discharged vertically, the cleaning nozzle is directed horizontally, and the cleaning agent should preferably be ejected in an atomized spray to clean the nozzle. If the liquid material is being discharged horizontally, the cleaning nozzle is oriented vertically, and the cleaning agent does not need to be atomized, but may be discharged against the nozzle by gravity, in drop form.

In all three embodiments, the hood provides an open inner space surrounding the nozzle orifice which promotes relatively stable and consistent humidity at the end of the nozzle, thereby minimizing or reducing viscosity changes in the discharged liquid during intermittent operation. The hood also prevents hardening of liquid at the end of the nozzle, thereby reducing the need to frequently clean the end of the nozzle. Finally, the hood also reduces the need for using harmful components to clean the nozzle end and minimizes the down time associated with liquid coating operations. The second and third embodiments actively prevent adherence and/or hardening of liquid on the nozzle by humidifying the open inner space and by rinsing the end of the nozzle, respectively.

These and other features of the invention will be more readily understood in view of the following detailed description and the drawings.

DETAILED DESCRIPTION OF THE PREFERRED EMBODIMENTS

Figure 1:
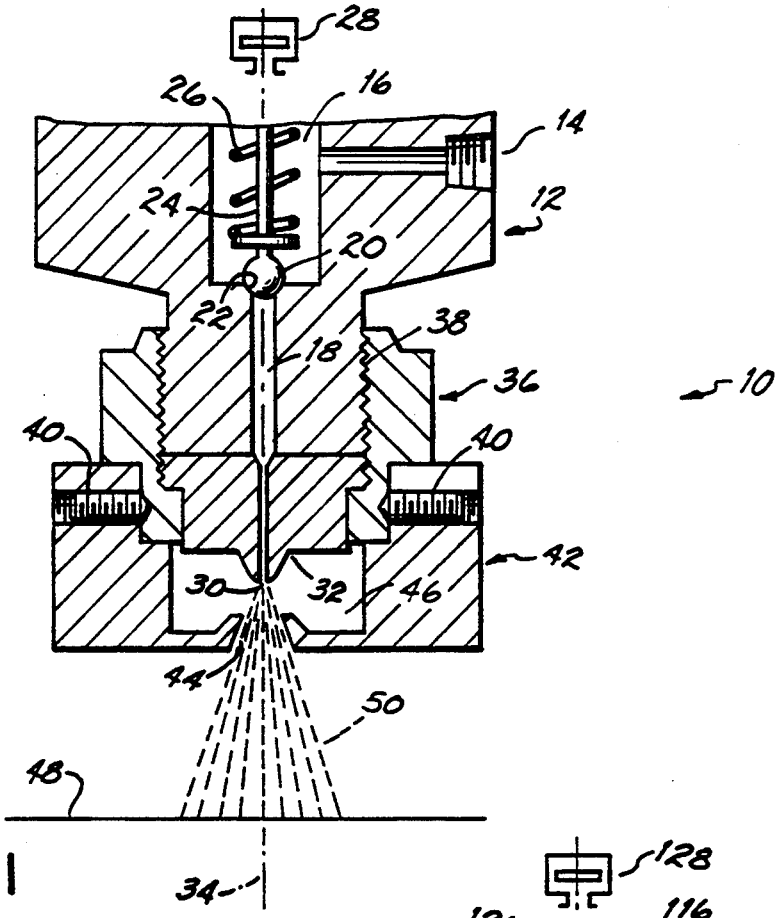
FIG. 1 is a longitudinal cross-sectional view of an apparatus particularly suitable for discharging a liquid which includes volatile components, in accordance with a first preferred embodiment of the invention.

FIG. 1 shows an apparatus 10 particularly suitable for discharging liquid which includes volatile components. The apparatus 10 includes a gun body 12 which has a discharge liquid inlet or entry 14 formed therein. This entry 14 communicates with an internal space 16, which resides in fluid communication with a discharge passage 18 when a spherical valve end 20 is moved away from a valve seat 22 formed within the gun body 12. The valve end 20 is mounted to the end of a valve stem 24. A compression spring 26 maintains the valve stem 24 and end 20 against the valve seat 22 in a seated condition until an actuator 28, which is operably connected to the valve stem 24, actuates to raise the stem 24 and the valve end 20.

The discharge passage 18 terminates at a nozzle orifice 30 located at a nozzle end 32 of the gun body 12. In the first preferred embodiment shown in FIG. 1, the discharge passage 18 and the nozzle orifice 20 are aligned along a vertical axis, designated by reference numeral 34.

Adjacent the nozzle end 32, a hood 42 is secured to the gun body 12. While FIG. 1 shows hood 42 secured to a nut 36 which is threadably secured to body 12 by a threaded connection 38, the invention also contemplates other structures for securing the hood 42 to the gun body 12. The hood 42 includes an opening 44 aligned with nozzle orifice 30, along axis 34. The hood 42 also defines an open inner space 46 surrounding the nozzle orifice 30 and the nozzle end 32.

In use, when a liquid which includes volatile components is discharged from nozzle orifice 30, the discharged liquid traverses the open inner space 46 and opening 44 enroute to a surface 48 to be coated, as shown by spray pattern 50. The open inner space 46 provides a stable environment around the nozzle orifice 30 of the gun body 12, thereby minimizing the effects of external conditions. This reduces the possibility of adherence and/or hardening of the liquid at the end of the nozzle 32 which may occur after a period of non-use, or even during intermittent operation.

The hood 42 also minimizes viscosity changes in the discharged liquid during intermittent operation, since the stable environment of the open space 46 reduces the escape of solvent through orifice 30 and the drying out of material on nozzle end 32. With reduced viscosity variation, the liquid is discharged more uniformly and consistently the next time valve end 20 is retracted from seat 22, which is an important feature when operating intermittently to coat individual articles carried on a conveyor.

Figure 2:
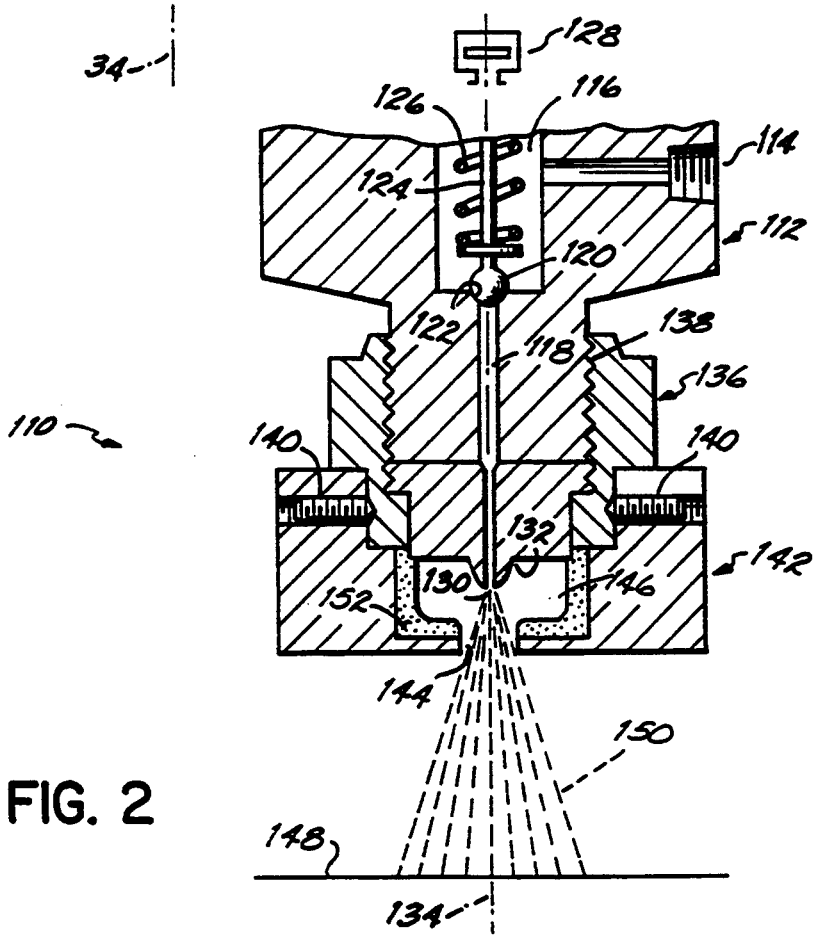
FIG. 2 is a longitudinal cross-sectional view of an apparatus particularly suitable for discharging a liquid, in accordance with a second preferred embodiment of the invention.

FIG. 2 shows a second preferred embodiment of the invention. In FIG. 2, structural components identical to structural components of FIG. 1 are designated by reference numerals which end in the same two digits but which are in the 100s.

In addition, the second embodiment includes a permeable element 152 located within the hood 142. Preferably, this element 152 is a water absorbent polymer mounted to an inside surface of the hood 142. By saturating or partially saturating the element 152 prior to discharge of a liquid, such as a water based coating, this apparatus 110 actively prevents drying of material through nozzle orifice 130 by increasing the humidity within the open inner space 146. In effect, the permeable element 152 humidifies the environment surrounding the nozzle orifice 130 at the nozzle end 132, thereby discouraging the evaporation of water from the coating through orifice 130 which would reduce the coatings' viscosity, and inhibiting drying or hardening of the water based coating on the nozzle end 132.

Figure 3:
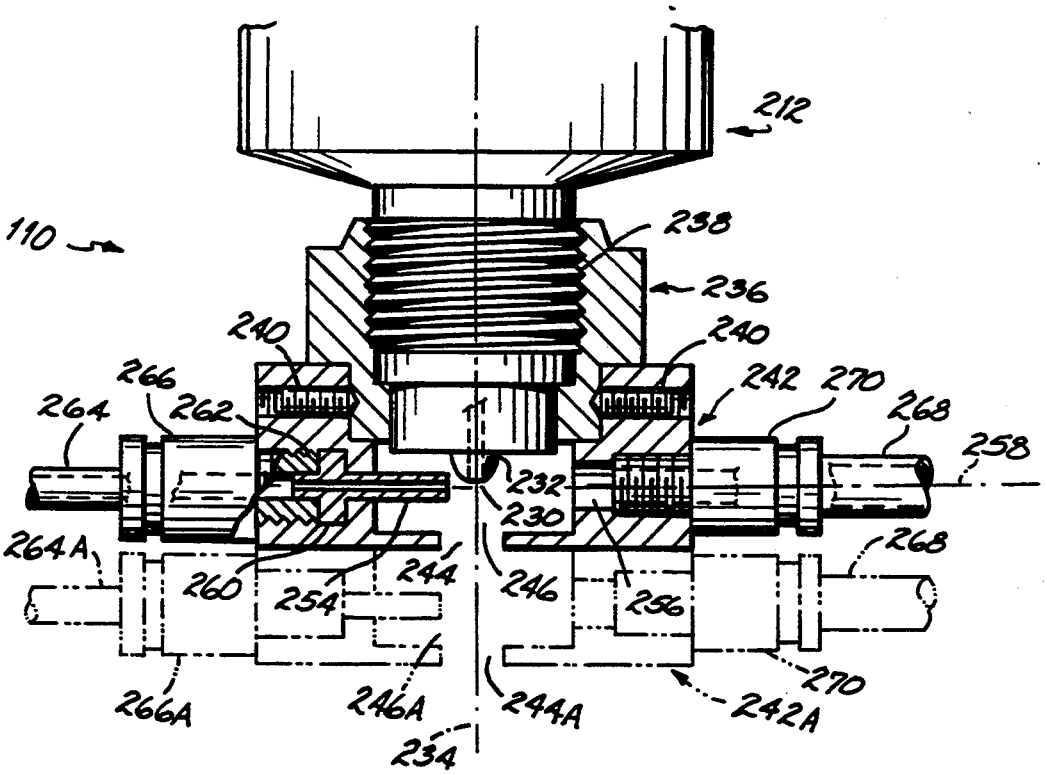
FIG. 3 is a longitudinal cross-sectional view of an apparatus particularly suitable for discharging a liquid which includes volatile components, in accordance with a third preferred embodiment of the invention.

FIG. 3 shows an apparatus 210 for discharging a liquid which includes volatile components, in accordance with a third preferred embodiment of the invention. As in the first and second preferred embodiments of the invention, shown in FIGS. 1 and 2, respectively, structural components in FIG. 3 are designated by reference numerals having the same last two digits as similar components in FIGS. 1 and 2, except the reference numerals are in the 200s.

The discharge apparatus 210 differs from the first two embodiments by including a cleaning nozzle 254 mounted within the open inner space 246 and aimed at the nozzle orifice 230. The cleaning nozzle 254 is aligned with an exhaust outlet 256, and the cleaning nozzle 254 and exhaust outlet 256 are aligned along a horizontal axis 258 which intersects the vertical discharge axis 234. Cleaning nozzle 254 further includes a collar portion 260 which is secured to the hood 242 by a threaded nut 262. A cleaning agent is supplied to the cleaning nozzle 254 via a hose 264 which is secured to the apparatus 210 via a hose coupling 266. Similarly, the exhaust outlet 256 communicates with an outlet hose 268 secured to the apparatus 210 by a hose coupling 270.

In operation, after discharge from nozzle end 232 of a liquid which includes volatile components, a cleaning agent can be directed from cleaning nozzle 254 toward outlet 256 to wash away any liquid coating or adhesive material remaining on nozzle end 232 to prevent adherence and/or hardening of the liquid on the nozzle end 232 of the gun body 212. The cleaning agent is sprayed at the nozzle end 232 during "off" portions of intermittent discharge operations. If the liquid material is a water based material the cleaning agent can be water, whereas if the liquid material is a solvent based material the cleaning agent can be a solvent.

In each case, use of the cleaning agent eliminates the need to clean the nozzle end 232 of the gun body 212 with harmful solvents, and also minimizes down time for the apparatus 210 due to cleaning. Also, because the cleaning agent is removed from the space 246 via an outlet 256 which is separate from the opening 244, the cleaning agent is significantly less likely to drip onto and damage a surface to be coated.

Figure 3A:
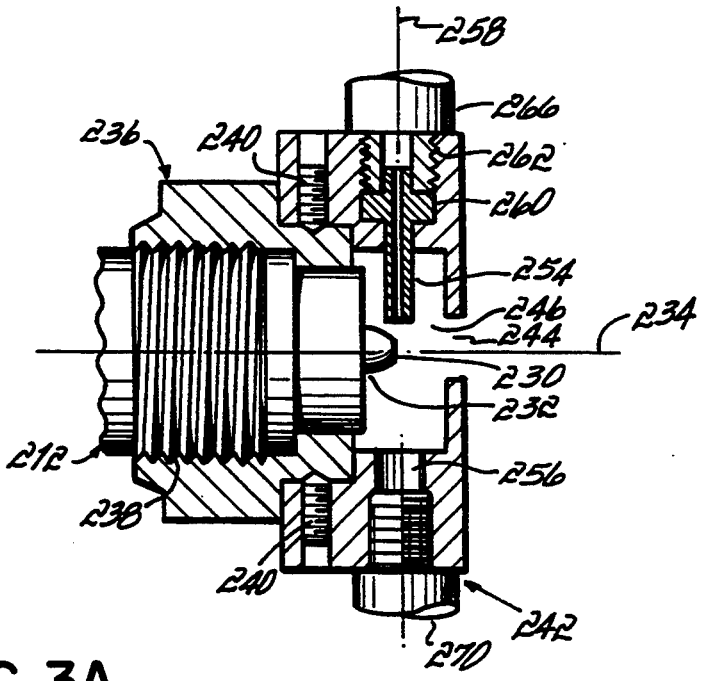
FIG. 3A is a longitudinal cross sectional view, similar to FIG. 3, of another variation of the third preferred embodiment of the invention.

FIG. 3 shows the nozzle orifice 230 and opening 244 aligned along a vertical axis 234, and cleaning nozzle 254 and exhaust outlet 256 aligned along a horizontal axis 258, an orientation which requires that the cleaning agent be directed from the cleaning nozzle 254 by spraying. However, it would also be possible to reorient the structure 210 so that the liquid is discharged horizontally and the cleaning agent is discharged or directed vertically. According to this reorientation, the cleaning agent may be dripped from the cleaning nozzle 254 by gravity, rather than being atomized and sprayed at the nozzle orifice 230 in a vertical direction. This variation of the third embodiment is shown in FIG. 3A.

FIG. 3 also shows another aspect of the invention which is applicable to all three embodiments. More specifically, FIG. 3 shows in phantom an additional hood **242*a* connected in series with the hood 242. For this additional hood 242*a*, like numbered components bearing reference numerals ending with the suffix "a" are identical to components described above which do not include the suffix "a". Basically, this additional hood 242*a* provides an additional stage of protection for the nozzle end 232 of the gun body 212. If two stages are used, the liquid must traverse a first open inner space 246 and a second open inner space 246*a* prior to exiting the apparatus 210**.

In all of the described embodiments of the invention, the hood 42, 142 or 242 provides a relatively stable environment around the nozzle orifice, along with some degree of humidity control and protection from external conditions. Additionally, the second embodiment provides active humidifying of the open inner space 146 adjacent the nozzle orifice 130, while the third preferred embodiment provides active prevention of adherence or hardening of liquid adjacent the nozzle orifice 230 by periodically washing nozzle end 232. As shown in FIGS. 1, 2, 3 and 3A, for each embodiment the nozzle orifice at the end of the through passage extends into the open inner space, via a nozzle protrusion which protrudes beyond the major portion of the nozzle end of the gun body.

While several preferred embodiments of the invention have been shown and described, it is to be understood that variations in these modifications may be made without departing from the scope of the invention. Accordingly, applicant wishes only to be bound by the claims appended hereto.

We claim:

1. An apparatus for discharging a liquid material, comprising:

a gun body having an inlet for the liquid material in fluid communication with a through passage which terminates at a nozzle orifice located at a nozzle end of the body;

a supply of liquid material in fluid communication with the inlet;

a valve mounted in the gun for controlling the flow of the liquid material through the nozzle orifice;

a hood mounted to the gun body and having a wall located opposite the nozzle end, the hood defining an open inner space between the wall and the nozzle end of the body, the wall having a single opening aligned with the nozzle orifice, the nozzle orifice extending into the open inner space but not to the wall.

2. The apparatus of claim 1 wherein the means for supplying and controlling the liquid material causes the liquid material to flow out the nozzle orifice intermittently.

3. An apparatus for discharging a liquid material, comprising:

a gun body having an inlet for the liquid material in fluid communication with a through passage which terminates at a nozzle orifice located at a nozzle end of the body;

a supply of liquid material in fluid communication with the inlet;

a valve mounted in the gun for controlling the flow of the liquid material through the nozzle orifice;

a hood mounted to the gun body and having a wall located opposite the nozzle end, the hood defining an open inner space between the wall and the nozzle end of the body, the wall having a single opening aligned with the nozzle orifice,the nozzle orifice extending into the open inner space but not to the wall; and a water permeable element mounted to the hood inside the open inner space.

4. An apparatus for discharging a liquid material, comprising:

a gun body having an inlet for the liquid material in fluid communication with a through passage which terminates at a nozzle orifice located at a nozzle end of the body;

a supply of liquid material in fluid communication with the inlet;

a valve mounted in the gun for controlling the flow of the liquid material through the nozzle orifice;

a hood mounted to the gun body and having a wall located opposite the nozzle end, the hood defining an open inner space between the wall and the nozzle end of the body, the wall having a single opening aligned with the nozzle orifice, the nozzle orifice extending into the open inner space but not to the wall; and a cleaning nozzle mounted within the hood between the nozzle end and the wall and directed at the nozzle end of the gun body, for directing a cleaning agent therethrough and against the nozzle end of the gun body.

5. The apparatus of claim 4 and further comprising:

an exhaust outlet formed in the hood in alignment with the cleaning nozzle.

6. The apparatus of claim 5 wherein the cleaning nozzle and the exhaust outlet are aligned along a first axis, and the nozzle orifice and hood opening are aligned along a second axis which is perpendicular to the first axis.

7. The apparatus of claim 1 and further comprising:

an additional hood mounted to the first hood to define a second open inner space, whereby liquid discharged from the gun body traverses two successive open inner spaces.

8. A method for discharging a liquid material, comprising the steps of:

supplying the liquid material to a gun body, the gun body having a passage formed therein which terminates at a nozzle orifice located at a nozzle end of the gun body;

controlling the flow of the liquid to the gun body, through the passage and out the nozzle orifice; and causing the liquid to traverse an open space defined by a hood surrounding the nozzle end of the gun body, the hood having a wall located opposite the nozzle end and the wall having a single opening which is aligned with the nozzle orifice,the nozzle orifice extending into the open inner space but not to the wall.

9. The method of claim 8 wherein the controlling step causes liquid to flow from the nozzle orifice in an intermittent manner.

10. The method of claim 8 and further comprising the step of:

locating a water permeable element inside the open inner space prior to the controlling and causing steps.

11. A method for discharging a liquid material, comprising the steps of:

supplying the liquid material to a gun body, the gun body having a passage formed therein which terminates at a nozzle orifice located at a nozzle end of the gun body;

controlling the flow of the liquid to the gun body, through the passage and out the nozzle orifice;

causing the liquid to traverse an open space defined by a hood surrounding the nozzle end of the gun body, the hood having a wall located opposite the nozzle end and the wall having a single opening aligned with the nozzle orifice, the nozzle orifice extending into the open inner space but not to the wall; and directing a cleaning agent from a cleaning nozzle toward the nozzle end of the gun body to wash any liquid material off of the nozzle end of the gun body, the cleaning nozzle located between the nozzle end and the wall.

12. The method of claim 11 wherein the cleaning agent is exhausted from the open space via an exhaust outlet aligned with the cleaning nozzle.

13. The method of claim 11 wherein the directing step further comprises spraying the cleaning agent.

14. The method of claim 13 wherein the cleaning agent is sprayed in a horizontal direction.

15. The method of claim 11 wherein the directing step further comprises dripping the cleaning agent vertically, by gravity, toward the nozzle end.

16. The method of claim 8 wherein the causing step includes traversal of the liquid through a second open inner space defined by a second hood secured to the first hood.

17. The method of claim 8 and further comprising the step of:

applying the discharged liquid to a surface of an object to be coated.

* * * * *